US006196672B1

(12) United States Patent
Ito et al.

(10) Patent No.: US 6,196,672 B1
(45) Date of Patent: Mar. 6, 2001

(54) HOT-MELT TYPE INK JET PRINTER HAVING HEATING AND COOLING ARRANGEMENT

(75) Inventors: Noritsugu Ito, Tokoname; Hiroshi Igarashi, Nagoya; Kazuya Asano, Nagoya; Shogo Suzuki, Nagoya; Shinji Kimura, Kani; Takashi Nakata, Nissin; Naoya Kamimura, Nagoya, all of (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/098,520

(22) Filed: Jun. 17, 1998

(30) Foreign Application Priority Data

| | | |
|---|---|---|
| Jun. 27, 1997 | (JP) | 9-171997 |
| Jun. 27, 1997 | (JP) | 9-171998 |
| Jul. 2, 1997 | (JP) | 9-176917 |
| Jul. 17, 1997 | (JP) | 9-192594 |

(51) Int. Cl.[7] ..... B41J 2/175; B41J 29/377
(52) U.S. Cl. ..... 347/88; 347/18
(58) Field of Search ..... 347/88, 104, 105, 347/18; 346/134; 400/649, 625

(56) References Cited

U.S. PATENT DOCUMENTS

| | | | | |
|---|---|---|---|---|
| 4,664,542 | * | 5/1987 | Tsugita | 400/124 |
| 5,005,025 | | 4/1991 | Miyakawa et al. | 347/88 |
| 5,043,741 | * | 8/1991 | Spehrley, Jr. | 347/88 |
| 5,406,316 | * | 4/1995 | Schwiebert et al. | 347/18 |
| 5,774,155 | * | 6/1998 | Median et al. | 347/102 |
| 5,847,719 | * | 12/1998 | Yamaguchi et al. | 347/104 |

FOREIGN PATENT DOCUMENTS

| | | | | |
|---|---|---|---|---|
| 3-58853 | * | 3/1991 | (JP) | 347/18 |
| 5-131620 | * | 5/1993 | (JP) | 347/104 |
| 2575136 | | 10/1996 | (JP) . | |

* cited by examiner

*Primary Examiner*—N. Le
*Assistant Examiner*—Judy Nguyen
(74) *Attorney, Agent, or Firm*—Oliff & Berridge, PLC

(57) ABSTRACT

A hot-melt type ink jet printer includes a nozzle head for ejecting a hot-melt type ink onto a sheet. The printer has a sheet feed passage defined by, in order from an upstream side in a sheet feeding direction, a sheet supply roller, a preheat platen, a sheet feed roller, a main platen, a cooling platen, discharge roller and a sheet discharge opening. The preheat platen and main platen have preheater and main heater, respectively, and these platen and the cooling platen are supported on a frame. A first suction port is formed between the main platen and the cooling platen and a second suction port is formed between the cooling platen and the frame. A power board and a cooling fan is provided within the frame for cooling the power board. By rotation of the cooling fan, air is introduced from the sheet discharge opening into the frame through the first and second suction ports to also cool the cooling platen and the heating platen.

24 Claims, 11 Drawing Sheets

HOT-MELT TYPE INK JET PRINTER HAVING HEATING AND COOLING ARRANGEMENT

BACKGROUND OF THE INVENTION

The present invention relates to an ink-jet printer using hot-melt type ink and capable of heating a recording medium such as a paper and cooling the recording medium after the hot-melt type ink has been printed on the recording medium.

A conventional hot-melt type ink-jet printer includes a recording head mounted on a carriage. The recording head includes a nozzle head having a plurality of nozzles, an ink melting section including a heater, and a hopper for storing solid ink pellets. Further, a platen is provided in confrontation with the nozzle head for supporting the recording medium. The carriage is moved in a main scanning direction orthogonal to a recording medium feeding direction, while hot-melt ink droplets are ejected from the nozzles in the nozzle head to form images such as characters and graphs on the surface of the recording medium. The hot melt ink, once printed on a print medium, is extremely durable and has a weather proof characteristic. Hot-melt ink liquefies when heated and hardens at room temperature. Therefore, to print using hot melt ink, the hot melt ink in the print head is heated and melted before it is ejected from the print head.

If the hot-melt ink is ejected from the nozzle heads onto the surface of the recording medium having a relatively low temperature, the ink droplet is immediately solidified at the surface. Therefore, ink fixing property on the recording medium may be lowered. Thus, the solidified ink may be easily peeled off from the surface of the recording medium to degrade the imaging quality. In this connection, the recording medium must be sufficiently heated prior to the ink ejection. To this effect, conveying speed of the recording medium must be low prior to the printing operation to obtain sufficient heat transmission to the recording medium. As a result, high speed printing cannot be performed.

If the hot-melt ink is ejected onto pre-heated recording medium having a prescribed elevated temperature, the fixing properties of the ink on the recording medium can be improved. However, downstream of the recording head, the recording medium continues to be fed between a discharge roller and a pinch roller. If the hot-melt ink fixed on the recording medium has not solidified completely before passing through these rollers, some of the ink is transferred to the pinch roller and the like, thereby reducing the quality of the printed image.

In order to avoid these problems, in a subsequent conventional printer, a heater is provided at a back side of the platen opposite a side along which the recording medium passes for increasing the temperature of the recording medium. Further, a sheet conveying distance between the platen and a discharge section including the discharge roller and the pinch roller is designed to be longer to allow the recording medium just printed to cool while being conveyed over this longer distance. This allows the hot-melt ink to solidify before reaching the discharge section.

However, in order to lengthen the conveying distance, it is necessary to increase the overall dimensions of the printer. Moreover, if the conveying speed of the recording medium is increased after printing operation, the time required to convey the recording medium from the printing portion to the discharge section is essentially decreased. As a result, it is impossible to achieve the cooling effect when performing high-speed printing on a printer of this construction and, therefore, impossible to achieve an image of desirable quality.

Further, in a conventional hot-melt type ink jet printer, a power board is provided in a main case of the printer. Since a temperature of the power board tends to be elevated, a cooling fan is provided in the main case to cool the power board by blowing air on the same. The cooling fan is disposed in a wall of the main case, from which location external air can be easily taken in or expelled.

U.S. Pat. No. 5,005,025 discloses an ink jet printer having a heater whose upstream part serves as a platen and whose downstream part extending to a discharge roller. Because the heater provides an elongated conveying path, sufficient heat can be transmitted to the recording medium for improving fixation.

SUMMARY OF THE INVENTION

In view of the foregoing, it is an object of the present invention to provide a hot-melt type ink jet printer compact in size and capable of performing high speed printing yet maintaining high imaging quality.

Further, attention is drawn to the utilization of the cooling fan which conventionally is used for cooling the power board. In the present invention, the recording medium must be sufficiently heated immediately before the ink ejection for improving the image-fixing. On the other hand, the fixed inked image must be immediately cooled to avoid ink transfer to the sheet discharge section. Thus, another object of the present invention is to provide the hot-melt type ink jet printer including the cooling fan which generates a stream of air for cooling not only the power board but also the recording medium so as to promote cooling of the recording medium, thereby allowing the formation of high quality images on the recording medium even during high-speed printing.

Still another object of the present invention is to provide such printer capable of providing a suitable heating temperature, a suitable cooling temperature, a suitable printing speed of the recording medium and a suitable discharge timing of the recording medium.

Still another object of the present invention is to provide such printer capable of performing efficient cooling to a power board provided in a printer frame.

These and other objects of the present invention will be attained by providing a hot-melt type ink jet printer for forming an inked image on an image receiving medium including a frame, a nozzle head, a main platen, a cooling platen, and a discharge roller. The nozzle head is movable relative to the frame and ejects a hot-melt ink onto the image receiving medium. The main platen has one surface in confrontation with the nozzle head. The image receiving medium is fed in a feeding direction along the one surface. The cooling platen is positioned downstream of the main platen in the feeding direction for cooling the inked image formed on the image receiving medium. The discharge roller is disposed downstream of the cooling platen for discharging the image receiving medium. The frame havs has a sheet discharge opening adjacent the discharge roller. An order of the main platen, the cooling platen and the discharge roller defines a sheet feed passage.

In another aspect of the invention, there is provided a hot-melt type ink jet printer for forming an inked image on an image receiving medium including a frame having a front side and a rear side, a nozzle head, a main platen, a main heater, a second platen, a fan, and a power board. The nozzle head is movable relative to the frame and ejects a hot-melt ink onto the image receiving medium. The main platen has one surface in confrontation with the nozzle head. The image receiving medium is fed in a feeding direction along the one surface. The main heater is provided at the opposite surface of the main platen for heating the main platen. The second platen is disposed immediately downstream of the main platen. A combination of the main platen and the second platen defines a sheet feed passage extending toward the front side of the frame. A first suction port is formed between the main platen and the second platen for introducing a cooling air into an interior of the frame through the first suction port. A second suction port is formed at the front side of the frame. The first suction port is open to the sheet feed passage and the second suction port is open to the front side. The fan is positioned at an intermediate portion between the front side and the rear side of the frame. The power board is positioned between the fan and the rear side of the frame. The power board is cooled by the cooling air introduced into the frame by the fan through the first suction port and the second suction port.

BRIEF DESCRIPTION OF THE DRAWINGS

In the drawings:

FIG. 6(*b*) is a cross-sectional view taken along the line VIB—VIB of FIG. 3;

DETAILED DESCRIPTION OF THE PREFERRED EMBODIMENTS

A hot-melt type ink-jet printer according to a preferred embodiment of the present invention will be described while referring to FIGS. 1 through 7.

Figure 1:
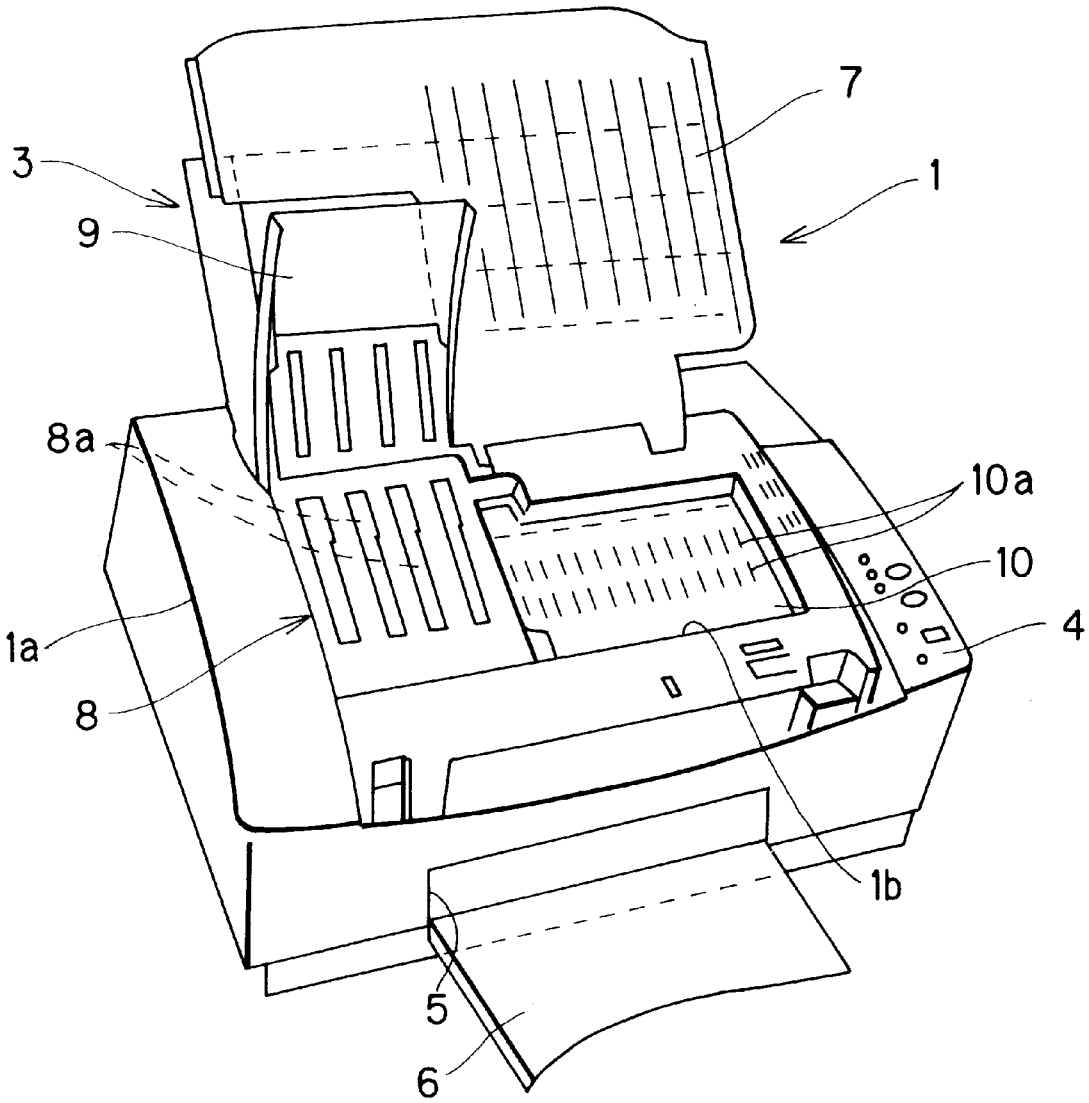
FIG. 1 is a perspective view showing a hot-melt type ink jet printer according to a preferred embodiment of the present invention.
Figure 2:
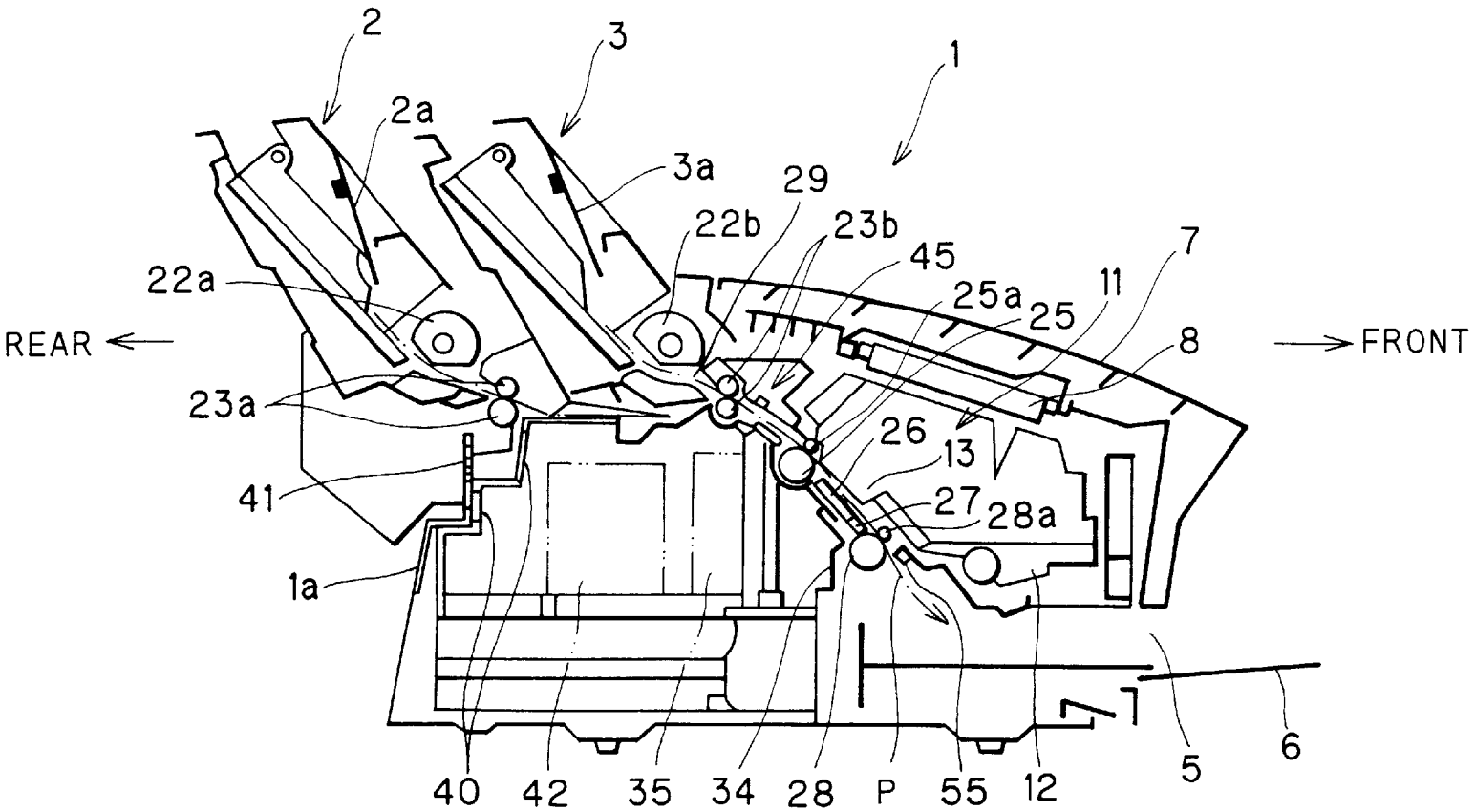
FIG. 2 is a side cross-sectional view of the hot-melt type ink-jet printer in FIG. 1.

As shown in FIG. 1, a hot-melt type ink jet printer 1 includes a main case 1*a*, a sheet supply unit 3 (another sheet supply unit 2 is shown in FIG. 2), an operation panel 4, a discharge tray 6, an upper cover 7 and a cover 9. The main case 1*a* has a top wall where a center opening 1*b* is formed. The sheet supply units 2 and 3 are detachably mounted in a top back portion of the main case 1*a* for accommodating stacks of recording mediums P, such as ordinary cut-sheet paper, transparent films for overhead projectors, and the like. The operation panel 4 is provided with various operating switches disposed on a right side top surface of the main case 1*a*. A sheet discharge opening 5 is formed on the front surface of the main case 1*a*, and the discharge tray 6 is provided to the opening 5 to receive the recording medium P after a printing operation.

The upper cover 7 is disposed on the top surface of the printer 1 and is capable of opening and closing to reveal or cover the center opening 1*b*. An ink case 8 serving as an ink pellet supply portion is detachably mounted in a left side of the center opening 1*b*. The ink case 8 contains a plurality of accommodation grooves 8*a* arranged in a row and capable of accommodating ink pellets (not shown) of the various colors of yellow, magenta, cyan, and black. The cover 9 is disposed on the top surface of the main case 1*a* and is capable of opening and closing in order to reveal and cover the top surface of the ink case 8. A transparent cover 10 is fixed on the right side of the ink case 8 and covers the right side of the center opening lb. The transparent cover 10 is formed with a plurality of vent slots 10*a*.

Next, an internal arrangement of the printer will be described with reference to FIG. 2. First, the sheet supply units 2 and 3 are arrayed in a frontward/rearward direction of the printer 1. Manual insertion trays 2*a* and 3*a* are provided in the top surface of the sheet supply units 2 and 3, respectively. A semi-circular or sector shaped sheet supply rollers 22*a* and 22*b* are disposed on the lower ends of the sheet supply units 2 and 3, respectively. A recording medium P either stacked in the sheet supply units 2 or 3, or hand-fed into the manual insertion tray 2*a* or 3*a*, is conveyed along a sheet feed passage 29. The sheet feed passage 29 is defined in order from upstream to downstream in a sheet feed direction, a register roller pair 23*a* and a register roller pair 23*b*, an optical sensor 45, a sheet feed roller 25 and pinch roller 25*a*, a main platen 26, a cooling platen 27, a discharge roller 28 and pinch roller 28*a*, a discharge sensor 55, the sheet discharge opening 5 and the discharge tray 6. A print head 11 is mounted on a carriage 12. The print head 11 includes a nozzle head 13 in confrontation with the main platen 26. A carriage motor 60 (FIG. 7) is provided for moving the nozzle head 13 back and forth in the main scanning direction.

A frame 34 is provided approximately in the front-to-back central section of the main case 1*a*, forming a hollowed space. Discharge ports 40 and 41 are formed in the back surface of the frame 34 and a back surface of the main case 1*a*, respectively. A cooling fan 35 is provided in an approximately center portion of the frame 34 and on the back side of both the main platen 26 and cooling platen 27 for introducing cooling air in the direction from the sheet discharge opening 5 into the interior of the frame 34. Further, a power board 42 is disposed within the frame 34 and between the cooling fan 35 and the discharge ports 40 and 41. Therefore, the power board 42 can be cooled by the cooling air introduced by the cooling fan 35. The discharge ports 40 and 41 are positioned so that an approximately linear air stream can be provided in the frame 34 between suction ports (described later) and the discharge ports 40, 41. Thus, flowing air can be concentrated into the linear stream within the frame 34.

Figure 4:
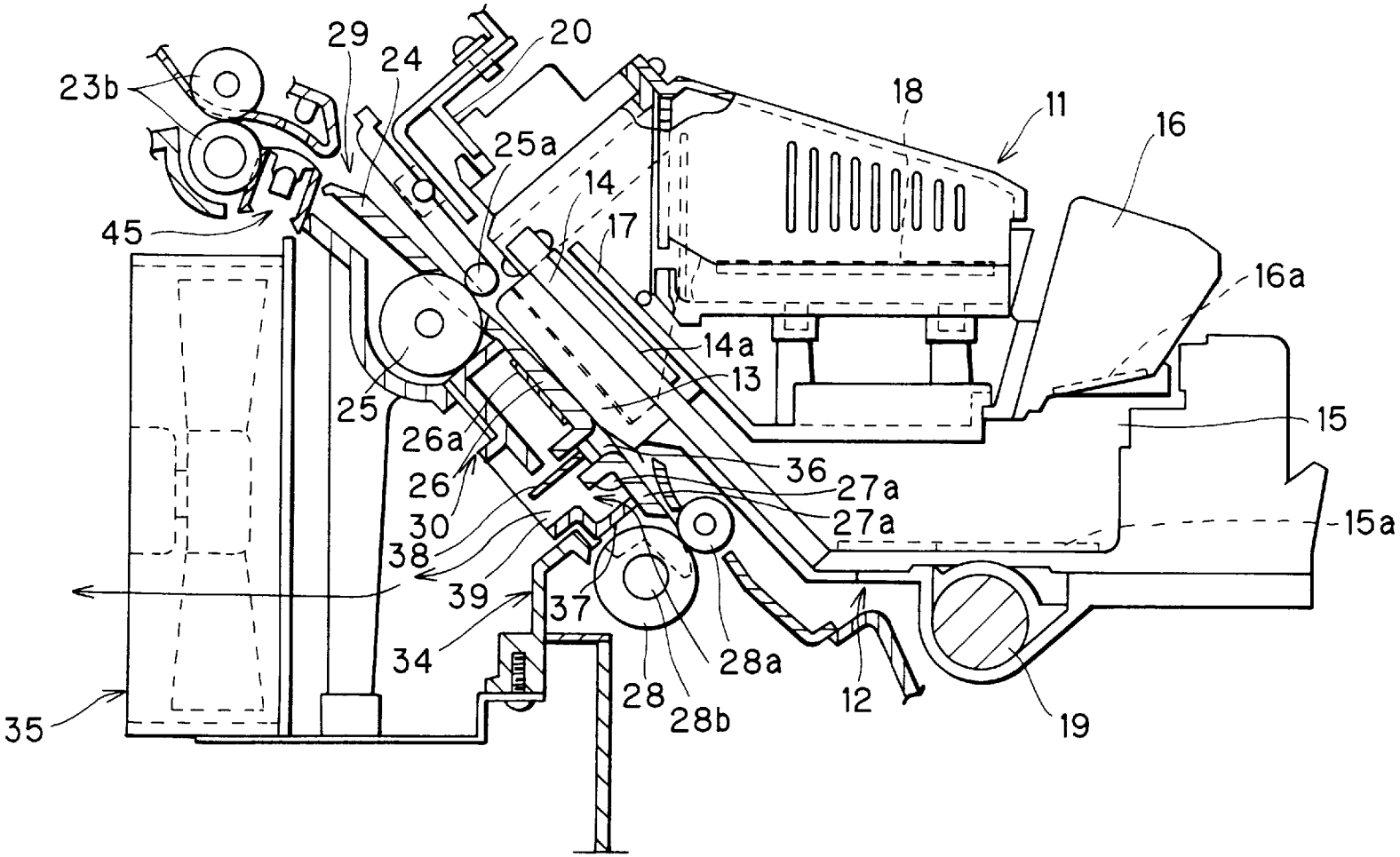
FIG. 4 is an enlarged cross-sectional view showing the relevant parts along a sheet feed passage according to the embodiment.

As shown in FIG. 4, the print head 11 includes the nozzle head 13, a front panel 14, an ink tank 15, a melt hopper 16, a lid panel 17, and a relay portion 18. The front panel 14 is formed with ink transport channels, and has a lower side supporting the nozzle head 13. The ink tank 15 is adapted for supplying ink to the nozzle head 13. An ink sensor (not shown) is provided in the ink tank so as to detect an ink level in the ink tank. The melt hopper 16 is adapted for melting ink pellets and refilling the ink tank 15. The lid panel 17 is adapted for covering the outer surface side of the front panel 14. The relay portion 18 is provided with a control circuit for controlling piezoelectric elements for executing ink ejection from the nozzle head 13, various heaters (described later), and the like.

A panel heater 14*a* is provided on an upper side of the front panel 14 for heating the ink transport channels. A heater 15*a* is provided on the outside of the ink tank 15 for maintaining the hot-melt ink at an appropriate temperature. A heater 16*a* is provided on the outside of the melt hopper 16 for melting the ink pellets.

A guide shaft 19 and a guide rail 20 extend in a lateral direction of the printer 1. The carriage 12 is driven to move in a back and forth direction (the lateral direction) according to a transport mechanism (not shown). The carriage 12 moves within the main case 1*a* in the sub scanning direction (orthogonal to the sheet feed direction), guided along the guide shaft 19 and the guide rail 20.

An ink pellet supply mechanism (not shown) is disposed below the front end of the ink case 8. During printing operations, ink is consumed, thereby reducing the amount of the various colors of hot-melt ink contained in the ink tank 15. When the ink sensors (not shown) detect that an ink color is running out, the carriage 12 is moved so as to position the section of the melt hopper 16 corresponding to the section of the ink tank 15 running out of ink below the portion of the ink case 8 storing the corresponding color of ink pellets. At this time, a driving section of the ink pellet supply mechanism is operated to release solid ink pellets of the prescribed color from the ink case 8 into the melt hopper 16. The ink pellets can maintain its solid state at a room temperature.

Figure 3:
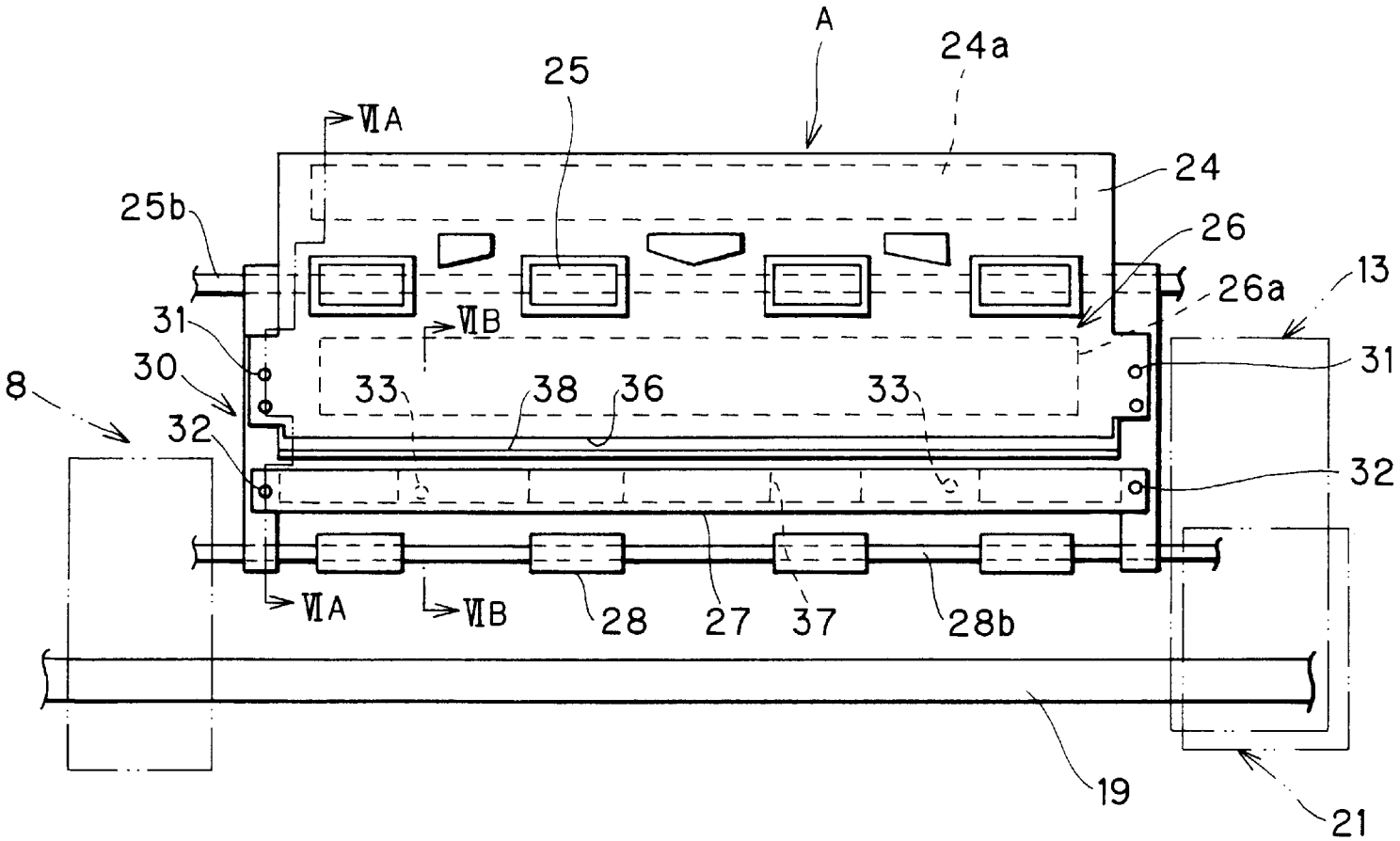
FIG. 3 is a plan view showing the positional relationship of a carriage, an ink case, and a maintenance operation portion according to the embodiment.

In addition, as shown in FIG. 3, a maintenance operation portion 21 is disposed on the right end in the main case 1*a* for purging the nozzles of the nozzle head 13 in order to prevent blockage of the nozzles during normal printing operations. This purge operation is accomplished by positioning the carriage 12 in a prescribed position and ejecting ink from the nozzles onto a testing roll paper provided in the maintenance operation portion 21. Further, as shown in FIG. 3, the sheet feed roller 25 and the discharge roller 28 are not continuous but are provided in regular intervals on support shafts 25*b* and 28*b*, respectively.

Figure 5:
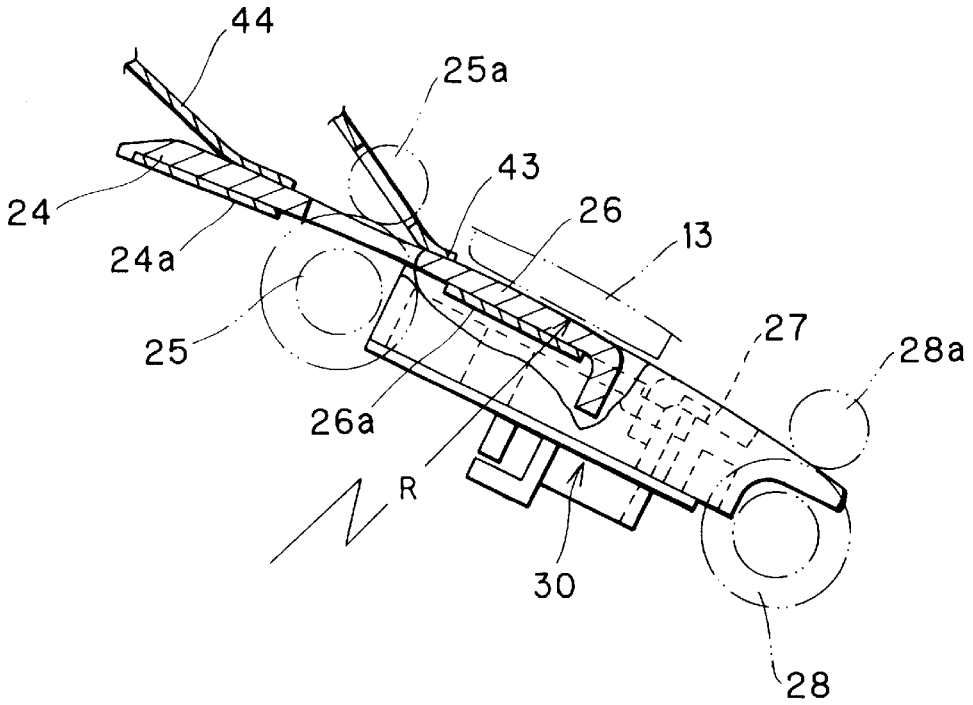
FIG. 5 is a side view of a main platen, a cooling platen, and a support frame according to the embodiment.
Figure 6A:
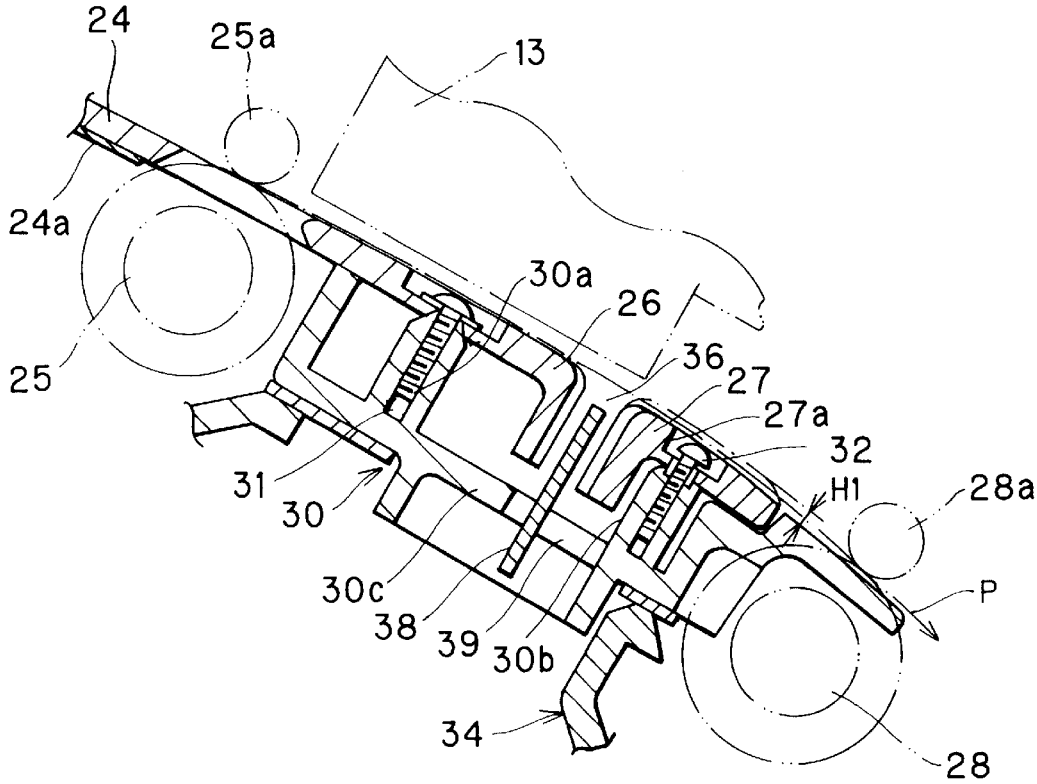
FIG. 6(*a*) is a cross-sectional view taken along the line VIA—VIA of FIG. 3.
Figure 6B:
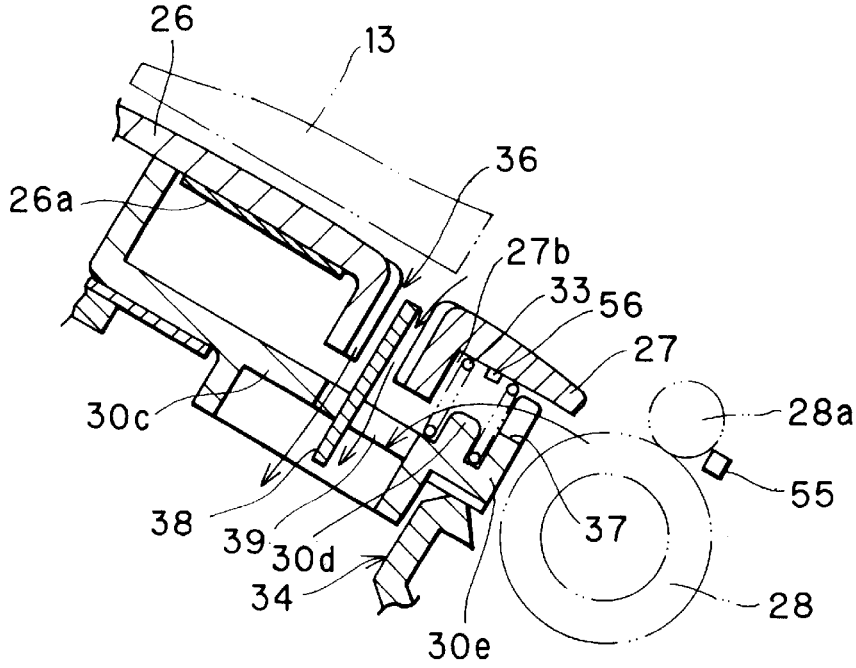

As shown in FIGS. 3 through 6(*b*), a support frame 30 is mounted on top of the frame 34. The support frame 30 is formed of a heat resistant synthetic resin material, such as polyetherimide, polyamideimide, polyimide, or the like. As shown in FIGS. 6(*a*) and 6(*b*), the support frame 30 has a bottom plate 30*c*, projecting portions 30*a* and 30*b* provided at left and right sides of the bottom plate 30*c* and projecting upwardly therefrom, a protrusion 30*d* projecting upwardly from the bottom plate 30*c* and at a widthwise center thereof, and a front wall plate 30*e*. The main platen 26 and the preheat platen 24 are provided integrally with each other. As shown in FIG. 3, a single plate member is sectioned into two areas by the sheet feed roller 25 to provide the main platen 26 and the preheat platen 24 positioned upstream of the main platen 26. More specifically, a plurality of elongated through holes are formed in the single plate member, and each sheet feed rollers 25 is disposed in each elongated through hole as shown in FIG. 3.

Left and right sides of the main platen 26 and the preheat platen 24 are supported onto the support frame 30 and is fixedly secured to the projecting portion 30*a* by screws 31 as shown in FIGS. 3 and 6(*a*). The preheat platen 24 and the main platen 26 are provided with a pre-heater 24*a* and main heater 26*a* on the back sides thereof, respectively for heating the recording medium P from the back sides. A surface temperature of the preheat platen 24 is preferably set higher than that of the main platen 26. Further, a pre-thermistor 69 and a main thermistor 70 (FIG. 7) are provided adjacent the preheat platen 24 and the main platen 26, respectively, for detecting a temperature of the preheat platen 24 and the main platen 26, respectively.

The cooling platen 27 is provided downstream of the main platen 26 in the sheet feeding direction for positively cooling the printed recording medium P when the latter is moved therealong in intimate contact therewith. Accordingly, ink transfer from the printed recording medium P to the discharge roller 28 and the pinch roller 28*b* can be avoided even by the high speed printing. The cooing platen 27 can reduce entire path length of the sheet feed passage from the main platen 26 to the discharge roller 28 because of the sufficient cooling effect.

Left and right sides of the cooling platen 27 are supported on the support frame 30. More specifically, the cooling platen 27 has recessed portions 27*a* (FIG. 6(*a*)) at left and right sides thereof and in confrontation with the projecting portion 30*b* of the support frame 30, and a screw 32 extends through each recessed portion 27*a* and threadingly engaged with the projecting portion 30*b*, so that the cooling platen 27 is unreleasably connected to the support frame 30 but can be movable toward and away from the top surface of the support frame 30 only a minute distance H1 (about 0.1–0.2 mm in the present embodiment). As shown in FIG. 6(*b*), a coil spring 33 is disposed between the widthwise central underside portion of the cooling platen 27 and the protrusion 30*d* of the support frame 30 so that the cooling platen 27 is urged by the coil spring 33 to protrude toward the nozzle head 13. The cooling platen 27 has a plurality of cooling fins 27*b* described later.

The preheat platen 24, main platen 26, and cooling platen 27 should be formed of a metallic material having high thermal conductivity, such as aluminum. At least the main platen 26 and the cooling platen 27 should have an outer surface (the surface contacting the underside of the recording medium P) formed in the shape of a convex curve with a radius R that protrudes toward the nozzle head 13. In the present embodiment, the preheat platen 24 and main platen 26 are formed as one piece, and therefore, the outer surface of the preheat platen 24 can also be formed in a convex shape with the radius R.

According to the construction described above, the recording medium P on the upstream side of the sheet feed passage 29 is pinched between the sheet feed roller 25 and pinch roller 25*a*, while the recording medium P on the downstream side of the sheet feed passage 29 is pinched between the discharge roller 28 and pinch roller 28*a*. Thus, tension is applied to the recording medium P as the same is conveyed along the sheet feed passage 29. Therefore, the entire underside surface of the recording medium P is supported and contacted by the convex surfaces formed by the preheat platen 24, the main platen 26, and the cooling platen 27. Therefore, thermal transfer can be executed efficiently from the surfaces of the preheat platen 24 and main platen 26 to the recording medium P. Similarly, thermal absorption (cooling) can be executed efficiently from the surface of the recording medium P to the cooling platen 27.

Further, when the recording medium P is conveyed along the sheet feed passage 29 by the sheet feed roller 25 and pinch roller 25*a* and the discharge roller 28 and pinch roller 28*a*, the entire surface of the cooling platen 27 along the conveying direction is pressed against the underside surface of the recording medium P by the biasing force of the coil spring 33. As a result, heat can be effectively transferred from the recording medium P to the cooling platen 27. Since the entire contour of the preheat platen 24, the main platen 26 and the cooling platen 27 provides a smooth arcuate configuration protruding toward the nozzle head 13, and since the recording medium P is conveyed along the arcuate surface in intimate contact therewith without any floating, and since the efficient heating and cooling can be performed, high speed feeding and high speed printing can be achieved. Because floating of the recording medium P can be avoided, the recording medium P is not trapped by the nozzle head even if a distance between the nozzle head 13 and the main platen 26 is set small. Accordingly, sheet jamming can be avoided.

The rotating speed of the discharge roller 28 is set faster than that of the sheet feed roller 25. Further, the pinching force between the discharge roller 28 and pinch roller 28*a* is set weaker than that between the sheet feed roller 25 and pinch roller 25*a*. Accordingly, the discharge roller 28 and the pinch roller 28*a* slip on the recording medium P enough to allow for the difference in speed from the rollers 25 and 25*a*. Although the pinching pressure between the rollers 28 and 28*a* is set lower, sufficient pressure is applied to prevent the recording medium P from floating up from the sheet feed passage 29 by the urging force of the cooling platen 27, which is resiliently urged by the coil springs 33.

As shown in FIG. 5, a main baffle 43 and an auxiliary baffle 44 are fixed at positions in a main case 1*a* for assuring intimate contact of the recording medium P with the platens 24, 26. The main baffle 43 has an intermediate portion formed with slots in which the pinch rollers 25*a* are disposed. The main baffle 43 has a free end in pressure contact with the upper surface of the main platen 26. The auxiliary baffle 44 has a free end in pressure contact with the upper surface of the preheat platen 24. These baffles 43 and 44 ensure that the recording medium P is more reliably prevented from floating above the sheet feed passage 29. The baffles 43 and 44 can be constructed from a heat resistant and resilient synthetic resin material such as polyimide film. However, in the present embodiment, a thin metal plate having a sufficient rigidity is used. For example, a phosphor bronze plate having a thickness of 0.1 mm is used for the main baffle 43, while a stainless steel plate having a thickness of 0.1 mm is used for the auxiliary baffle 44. Although the main baffle 43 does not necessarily need to be composed of phosphor bronze, better experiment results were obtained with this material than when using stainless steel. This may be due to the difference in thermal conductivity. Further, either one of the main baffle 43 and the auxiliary baffle 44 can be dispensed with.

In the depicted embodiment, a cooling air stream is provided by the cooling fan 35. To this effect, suction ports (described later) are formed at a position downstream of the main platen 26. Thus, upon rotation of the cooling fan 35, external air is introduced into the main case 1*a* through the sheet discharge opening 5 and is then introduced into the frame 34 through the suction ports, and the introduced air is discharged to the atmosphere through the discharge ports 40 and 41. The air stream runs toward the cooling platen 27 to cool the same.

More specifically, as shown in FIGS. 2, 4, 6(*a*), and 6(*b*), the cooling fan 35 is disposed within the hollow frame 34, which is positioned below the sheet feed passage 29 and approximately in the front-to-back center of the main case 1*a*. The support frame 30 is mounted in the top forward portion of the frame 34. By positioning the main platen 26 fixed to the support frame 30 and the cooling platen 27 so as to be separated by a prescribed distance, a first suction port 36 is formed along the width of the nozzle head 13 in the sub scanning direction and between the downstream end of the main platen 26 and the upstream end of the cooling platen 27. An elongated adiabatic partition plate 38 composed of a heat-resistant synthetic resin is disposed in the first suction port 36, thermally separating the downstream end of the main platen 26 and the upstream side of the cooling platen 27.

A plurality of second suction ports 37 is formed between the bottom surface of the cooling platen 27 on the downstream end and at the front wall plate 30*e* of the support frame 30. The second suction ports 37 are spaced at appropriate intervals along the sub scanning direction of the nozzle head 13 at appropriate lengths between the sections of the discharge roller 28. In other words, the second suction ports 37 correspond to bare portions of the support shaft 28*b* not containing sections of the discharge roller 28. Incidentally, the discharge roller 28 need not be limited to four locations along the support shaft 28*b* (FIG. 3), but can be distributed in six or more locations along the support shaft 28*b*. Also, the second suction ports 37 need not be limited to the intervals between the sections of the discharge roller 28, but can be formed as one long second suction port 37 that spans the entire width of the cooling platen 27. The plurality of cooling fins 27*b* (see FIG. 6(*b*)) are provided to the underside surface of the cooling platen 27 in positions opposing the second suction ports 37 in order to promote cooling of the cooling platen 27 by the cooling air passing through the second suction port 37 because a cooling area is increased by the area of the cooling fins 27*b*.

An air passage hole 39 is formed in the bottom plate 30*c*, providing fluid communication between the first suction port 36 and the second suction ports 37 and guiding cooling air to the cooling fan 35, as shown in FIGS. 4, 6(*a*), and 6(*b*). The adiabatic partition plate 38 extends into the air passage hole 39 so as to ensure heat separation from the heat of the main platen 26. The support frame 30 serves different functions, i.e., serves for allowing air to pass therethrough as well as for supporting the platens 24, 26 and 27. Therefore, parts or components of the printer can be reduced.

The optical sensor 45 (FIG. 2) is of a light-transmission type, and is provided along the sheet feed passage 29 between the register roller pair 23*b* and the preheat platen 24 in order to determine the type of recording medium P. In other words, the optical sensor 45 is provided to determine if the recording medium P is normal paper or transparent paper, such as transparent film used in overhead projectors. The optical sensor 45 outputs detection signals to control the temperature conditions of a heater described later. The discharge sensor 55 (FIG. 2, FIG. 6(*b*)) is provided at a position adjacent the pinch roller 28*a* for detecting discharge of the recording medium P. Further, a temperature sensor 56 is provided to the undersurface of the cooling platen 27 as shown in FIG. 6(*b*). The temperature sensor 56 serves to detect the temperature of the cooling platen 27.

Figure 7:
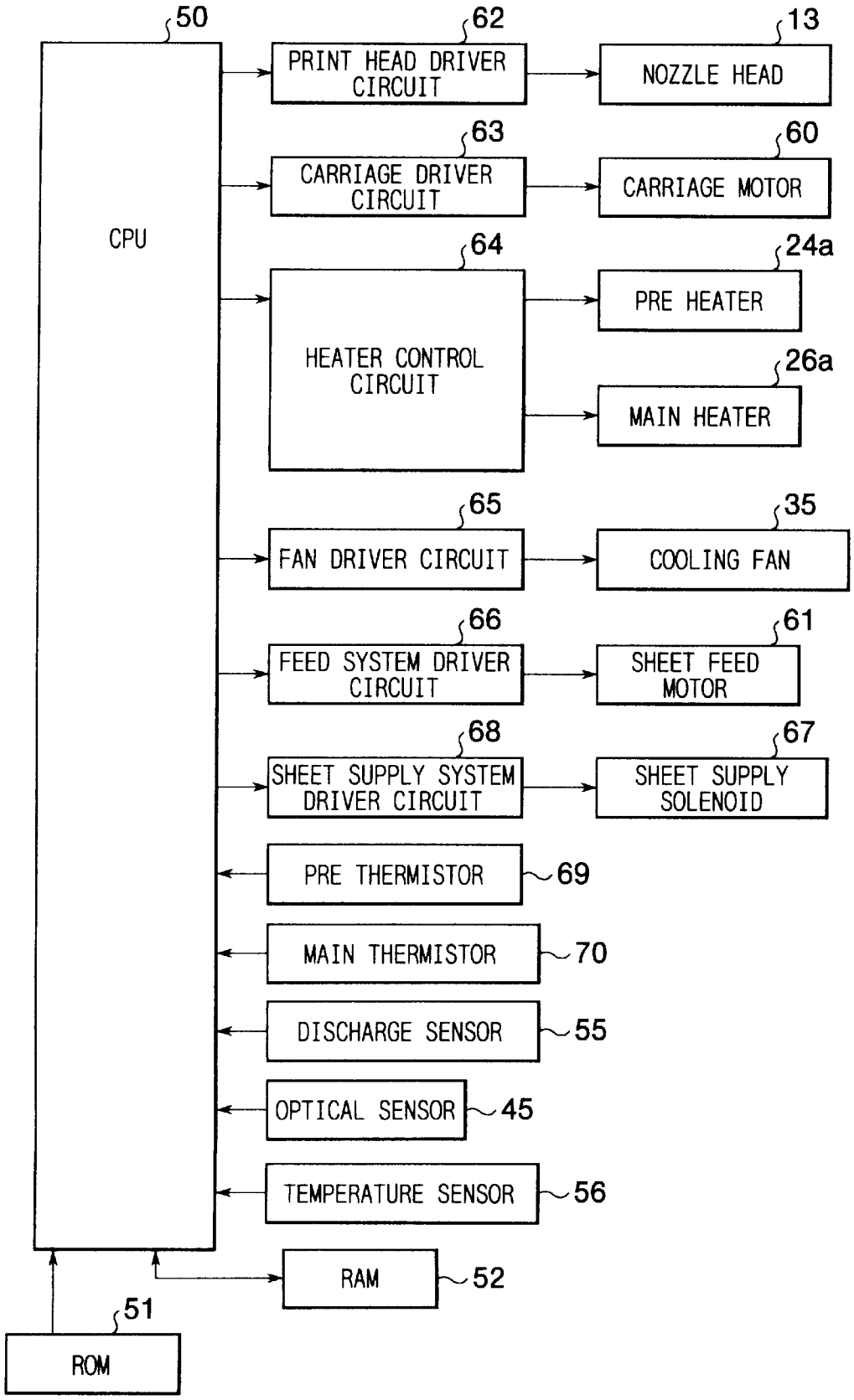
FIG. 7 is a block diagram showing a control system according to the embodiment.

Next, the control system of a hot-melt type ink jet printer having the construction described above will be described with reference to the block diagram in FIG. 7.

The control system includes a CPU 50, a ROM 51, a RAM 52 and various driver circuits. The CPU 50 executes various computation and control operations necessary for printing color images based on print data transmitted from a host computer (not shown). The operations are executed according to various control programs stored in the ROM 51. The ROM 51 stores various control programs and settings for control temperatures of the preheat platen 24 and/or main platen 26 corresponding to the type of recording medium P and the printing resolution. The ROM 51 also stores a head control program for controlling drive of a carriage driver circuit 63 and a print head driver circuit 62. The RAM 52 is adapted for temporarily storing print data sent from the host computer and temporarily serves as a work area for executing various control routine.

To the CPU 50 are connected a print head driver circuit 62, a carriage driver circuit 63, a heater control circuit 64, a fan driver circuit 65, a feed system driver circuit 66, and a sheet supply system driver circuit 68. The print head driver circuit 62 is adapted for driving the nozzle head 13 based on print data at a predetermined timing to eject ink from the nozzle head 13 in order to print predetermined images such as characters. The carriage driver circuit 63 is adapted for driving the carriage motor 60 to move the carriage 12 reciprocally in the main scanning direction. The heater control circuit 64 is adapted for controlling electrical supply to the pre-heater 24*a* and the main heater 26*a*. The fan driver circuit 65 is adapted for driving the cooling fan 35. The feed system driver circuit 66 is adapted for driving a sheet feed motor 61. For example, when the sheet feed motor 61 is rotated in a normal direction, the sheet feed roller 25 and discharge roller 28 are rotated in the sheet feeding direction, and if the sheet feed motor 61 is reversely rotated, the ink supply mechanism or the maintenance operating portion 21 is selectively operated. Thus, is controlled the feed mode of the recording medium P in an auxiliary scanning direction, which is substantially perpendicular to the reciprocal scan direction of the carriage 12, so that the recording medium P is moved past the print head 11 and onto the discharge tray 6. The sheet supply system driver circuit 68 is adapted for driving a sheet supply solenoid 67 which selectively operates one of the sheet supply rollers 22*a* and 22*b* in order to feed the recording medium P along the sheet feed passage 29. Further, the pre thermistor 69 for detecting the temperature of the preheat platen 24 and the main thermistor 70 for detecting the temperature of the main platen 26 are connected to the CPU 50. Furthermore, the optical sensor 45, the discharge sensor 55 and the temperature sensor 56 are also connected to the CPU 50. The pre thermistor 69, main thermistor 70, and optical sensor 45 are configured to output prescribed control signals for either the heater control circuit 64 or the fan driver circuit 65 based on the various detection signals described above.

Next, heating and cooling operations conducted according to the above-described configuration will be described. When a power switch (not shown) on the printer 1 is rendered ON, the printer 1 enters a standby state for printing operation. The printer 1 begins heating operations by flowing an electric current to the pre-heater 24*a* and main heater 26*a* and also begins rotating the cooling fan 35. Air drawn in through the sheet discharge opening 5 is introduced into the sheet feed passage 29 and the downstream side of the cooling platen 27. The air then enters the frame 34 via both the first suction port 36 and the second suction ports 37 because during this standby state the first suction port 36 is not blocked by the recording medium P. The air passes through the air passage hole 39, and is drawn through the cooling fan 35, and finally is exhausted out of the back side of the main case 1*a*. That is, the cooling air flows along the surface of the power board 42 absorbing heat from the same and is exhausted out of the main case 1*a* via the discharge ports 40 and 41. During the standby state, the number of revolutions of the cooling fan 35 is reduced to less than that during printing operations, and electrical supply to the pre-heater 24*a* and main heater 26*a* is also reduced to lower power consumption. Further, during initial start-up period of the printer 1, suction amount of the cooling air can be reduced so as to rapidly elevate the temperature of the main platen 26.

When printing operations are begun, electrical power supply to the pre-heater 24*a* and main heater 26*a* is returned to a prescribed amount in order to maintain the preheat platen 24 and main platen 26 at prescribed temperatures. When the printer 1 receives a paper supply command, after selection of the type of recording medium P, the specified sheet supply roller 22*a* or 22*b* is rotated to feed the leading edge of the selected recording medium P as far as either the register roller pair 23*a* or register roller pair 23*b*. After the leading edge of the recording medium P is registered, that is, after the diagonal feeding of the recording medium P is corrected, the recording medium P is conveyed toward the sheet feed roller 25.

The recording medium P is pressed against the surface of the preheat platen 24 by the resilient auxiliary baffle 44 and is preheated. Next, the recording medium P is pressed against the surface of the main platen 26 by the main baffle 43 and receives a main heating. When the leading edge of the recording medium P passes over the first suction port 36, the underside surface of the recording medium P does not float above the convex curved surface of the main platen 26 because suction force is imparted to the recording medium P. Hence, the recording medium P can reliably be heated by the main platen 26.

In this way, the recording medium P is intimately contacted with and supported by the preheat platen 24 and main platen 26 and is heated to a specified temperature while being fed. Since the recording medium P is heated, hot-melt ink ejected from the nozzle head 13, which opposes the main platen 26, fixes readily to the recording medium P. Next, when the recording medium P becomes nipped between the discharge roller 28 and the pinch roller 28*a*, the first suction port 36 is completely blocked by the recording medium P. Therefore, almost no air flows through this first suction port 36, while a large volume of air flows into the frame 34 via the second suction ports 37, located beneath the cooling platen 27.

Further, the portion of the printed recording medium P between the sheet feed roller 25 and the discharge roller 28 is maintained in close contact with the convex curved surface of the cooling platen 27 because of the urging force of the coil springs 33 as shown in FIG. 6(*b*). Therefore, the underside surface of the recording medium P can be pressed entirely against the cooling platen 27. Accordingly, it is possible to achieve highly effective heat transfer from the recording medium P to the cooling platen 27 to expedite the cooling of the recording medium P.

The large volume of air drawn into the frame 34 through the second suction ports 37 rapidly reduces the temperature of the cooling platen 27, allowing the cooling platen 27 to quickly absorb heat from the recording medium P, which contacts the surface of the cooling platen 27 as the recording medium P is being discharged. Therefore, the hot-melt ink fixed to the recording medium P easily solidifies while being conveyed to the discharge section and before the inked portion being nipped between the discharge roller 28 and pinch roller 28*a*. The hot-melt ink solidifies before reaching this discharge section even if a path length up to the discharge roller is relatively short, and even when the printing speed is increased and the recording medium P is conveyed rapidly in the feeding direction. Accordingly, the freshly printed hot-melt ink is not transferred to the pinch roller 28*a*, and the quality of the printing can be maintained even in the high speed printing operation.

The adiabatic partition plate 38 disposed in the first suction port 36 serves to block heat radiated from the main platen 26, which must be maintained at a high temperature, and to prevent the heat from transferring to the cooling platen 27 to thus allow the cooling platen 27 to be reliably maintained at a low temperature.

In the present embodiment, when printing on normal paper, the surface temperature of the main platen 26 is set at 68° C. for a resolution of 300 dpi and 65° C. for a resolution of 600 dpi. When printing on transparent film for overhead projectors, the surface temperature of the main platen 26 is set to 80° C. for 600 dpi. Accordingly, when it is necessary to change the type of recording medium P or printing conditions, the temperature of the main platen 26 during printing operations must be quickly adjusted.

For example, when modifying one of the above conditions, particularly when the temperature of the main platen 26 must be rapidly reduced, it is necessary to increase the cooling effect on the main platen 26 by air drawn in through the first suction port 36. To accomplish this, the revolutions of the cooling fan 35 are increased with a state where the first suction port 36 is not blocked by the recording medium P, and the adiabatic partition plate 38 is provided in the first suction port 36. This configuration increases the velocity of air flowing through the narrow channel formed between the downstream end of the main platen 26 and the adiabatic partition plate 38, thereby increasing the cooling effect on the main platen 26. This cooling effect can be further improved by forming the gap between the main platen 26 and the adiabatic partition plate 38 in a nozzle-like shape with a narrow inlet and a wide outlet leading toward the interior of the frame 34.

In the-depicted embodiment, since the suction ports 36 and 37 are positioned downstream of the main platen 26 in the sheet feeding direction, the main platen 26 is positioned at the leeward side of the cooling platen 27 with respect to the cooling air flowing direction. Accordingly, a heat released from the main platen 26 cannot be easily directed toward the cooling platen 27 but is urged toward the leeward side of the cooling platen 27. Thus, the cooling platen 27 can be protected against heat from the main platen 26, and consequently, the cooling platen 27 can be effectively cooled by the cooling air.

Further, because of the geometrical arrangement of the suction ports 36 and 37, if the first suction port 36 is not blocked by the recording medium P, the cooling platen 27 can be effectively cooled by the air flowing through both the first and second suction ports 36,37, and the preheat platen 24 and the main platen 26 can also be cooled by the air through the first suction port 36. Therefore, temperature of the preheat platen 24 and the main platen 26 can be lowered or controlled depending on the kind of the recording medium and the printing condition. Thus, efficient printing process can result. During printing operation, the cooling platen can be effectively cooled by the air through the second suction port 37. Taking the air flowing direction into consideration, by disposing the cooling fan 35 at a center portion of the frame 34, the air flow at upstream of the cooling fan 35 is utilized effectively for cooling the cooling platen 27 and the heating platen 26, and the air flow at downstream of the cooling fan 35 is utilized for cooling the power board 42. Consequently, a compact device with efficient cooling results.

Next, control routine for providing a suitable heating temperature, a suitable cooling temperature, a suitable printing speed and a suitable discharge timing of the printed recording medium will be described.

To enable the cooling platen 27 to sufficiently cool printed medium even under conditions that tend to heat up the cooling platen 27, such as consecutive printing and relatively high ambient temperatures, the cooling platen 27 needs to be formed in a certain size and length. For this reason, the ink jet printer itself must be large enough to hold the large cooling platen. Therefore, a printer capable of properly cooling the printed recording medium without increasing the size of the cooling platen is required.

Figure 8:
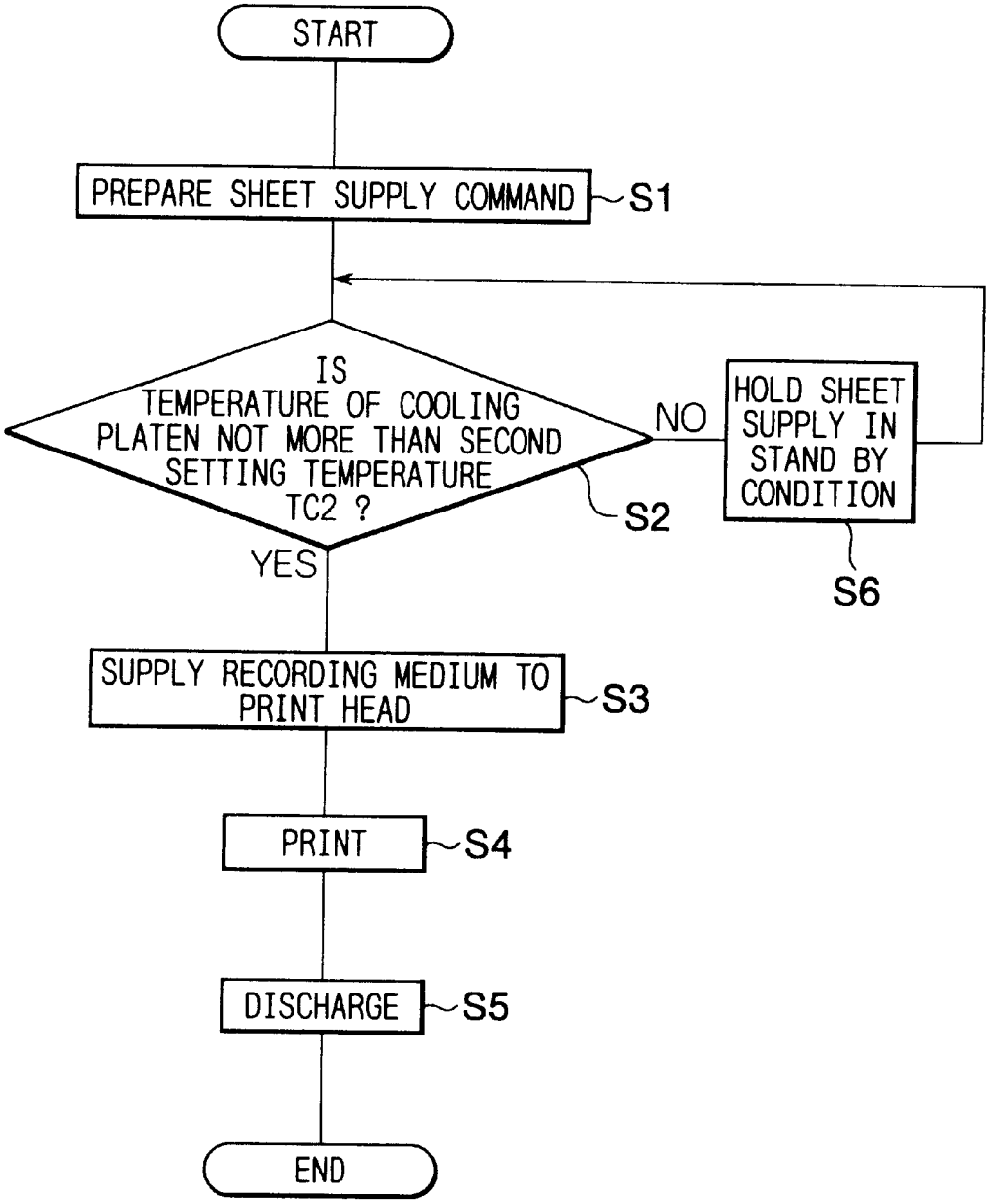
FIG. 8 is a flowchart representing a process for controlling a sheet supply timing.

To this effect, in accordance with one embodiment of a control routine shown in FIG. 8, the CPU 50 controls a timing of supply of the recording medium P from the sheet supply unit 2 or 3 to the print head 11 according to temperature of the cooling platen 27 detected by the temperature sensor 56.

FIG. 8 shows a flowchart indicating the timing control. The routine is started when a printing execution command is inputted, for example, when new print data is received from the host computer (not shown) for printing a first sheet of recording medium P or when the discharge sensor 55 detects discharge of a previously printed recording medium P for performing a subsequent printing operation in response to this detection.

Input of such a printing execution commands indicates a standby state for sending a sheet supply command signal to the sheet supply system driver circuit 68 for starting drive of the sheet supply unit 2 or 3. Therefore in S1, a sheet supply command for driving the sheet supply units 2, 3, that is, to rotate one of the sheet supply rollers 22*a*, 22*b*, is prepared for transmission to the sheet supply system driver circuit 68. Next in S2, it is determined whether or not the temperature of the cooling platen 27 detected by the temperature sensor 56 is equal to or less than a second setting temperature TC2. The second setting temperature TC2 is prestored in the ROM 51 and is the upper maximum temperature, for example, 50° C., at which the cooling platen 27 can properly cool the printed recording medium P.

When temperature detected by the temperature sensor 56 is equal to or less than the second setting temperature TC2 (S2:YES), then in S3, the sheet supply command signal for driving the sheet supply unit 2 or 3 is transmitted to the sheet supply system driver circuit 68 so that one of the sheet supply rollers 22*a*, 22*b* is rotated to supply a recording medium P to the print head 11. Next, the recording medium P is printed on by the print head 11 in S4 and is discharged in S5, thereby ending this routine.

On the other hand, when the temperature of the cooling platen 27 exceeds the second setting temperature TC2 (S2:NO), then in S6, the transmission of the sheet supply command signal to the driver circuit 68 is suspended until the temperature of the cooling platen 27 cools to equal or less than the second setting temperature TC2. That is, the routine goes back to S2.

Such a control routine can be advantageously used under circumstances where the temperature of the cooling platen 27 tends to rise above the second setting temperature TC2, so that the cooling platen 27 can not sufficiently cool the printed recording medium P. Such circumstances include when the printer is used in a relatively high ambient temperature and/or when the printer is used to perform printing of consecutive sheets. When the temperature of the cooling platen 27 exceeds the second setting temperature TC2, the control routine represented by the flowchart of FIG. 8 delays supply of recording medium P to the print head 11 until the temperature of the cooling platen 27 drops to a temperature not more than the second setting temperature TC2, whereby the cooling platen 27 can sufficiently cool the printed recording medium P. Accordingly, the recording medium P will always contact the cooled cooling platen 27 having temperature not more than the second setting temperature TC2 so that the cooling platen 27 can sufficiently cool the printed recording medium P. As a result, the recording medium P will always be properly cooled. For this reason, there is no need to increase the size or the length of the cooling platen 27 with efficient printing performance.

Figure 9:
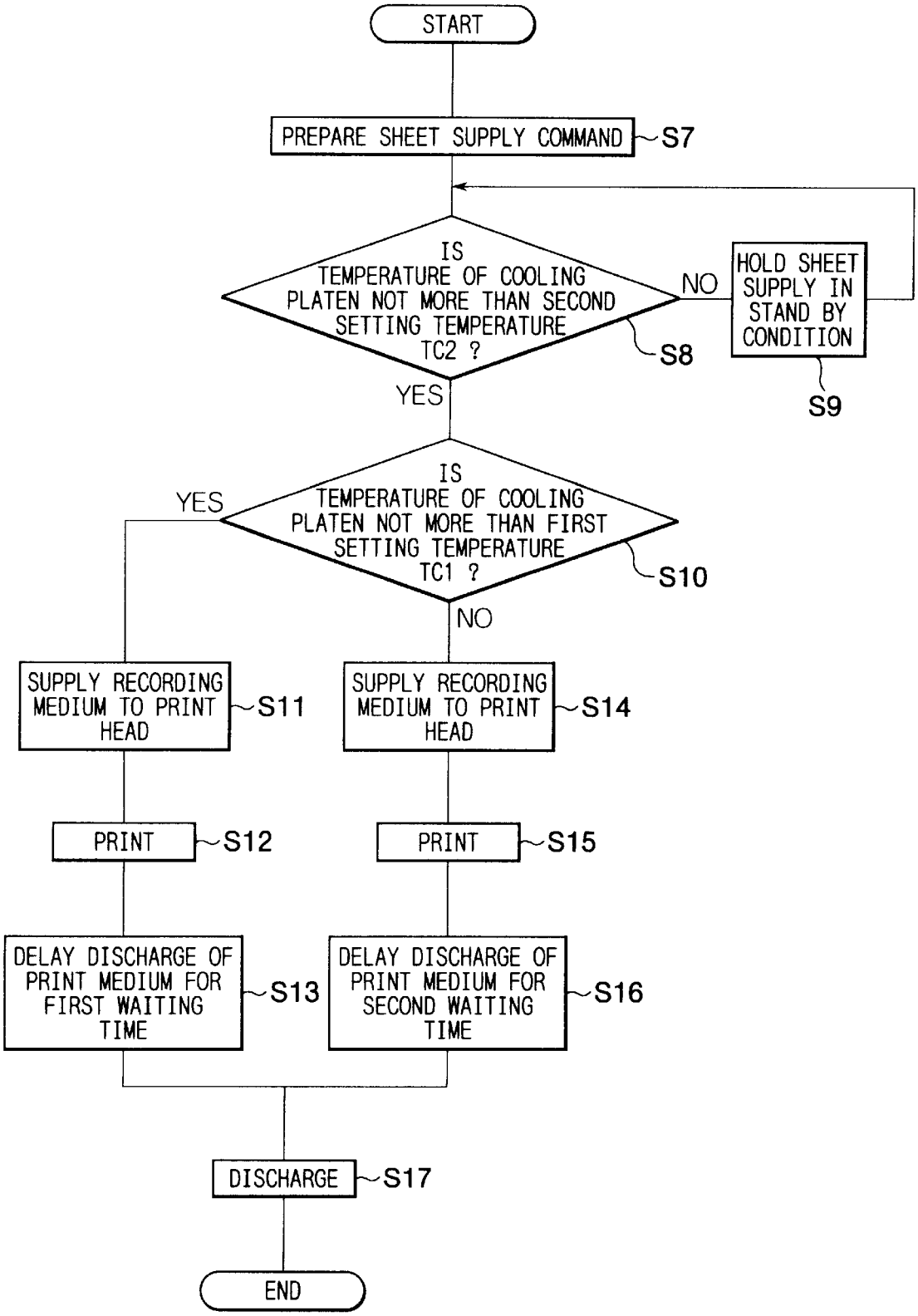
FIG. 9 is a flowchart representing a process for controlling sheet supply timing and sheet discharge timing according to a modified control routine.

A control routine according to a first modification is shown in a flowchart of FIG. 9. The first modification pertains to an improvement on the foregoing control routine in that the printed recording medium is maintained on the cooling platen 27 for a controlled period in accordance with the temperature of the cooling platen 27, the temperature being detected by the temperature sensor 56. In other words, the first modification further controls a timing of the discharge of the printed recording medium from the cooling platen 27.

This routine starts in the same manner as the routine explained while referring to the flowchart of FIG. 8. Further, the steps S7, S8 and S9 are identical with the steps S1, S2, S3, respectively, in the control routine shown in FIG. 8.

When the temperature of the cooling platen 27 is equal to or less than the second setting temperature TC2 (S8:YES), then, in S10, it is determined whether or not the detected temperature of the cooling platen 27 is equal to or less than a first setting temperature TC1 of, for example, 45° C. When the detected temperature is not more than the first setting temperature TC1 (S10:YES), then in S11, one of the sheet supply units 2 or 3 is controlled to supply a recording medium P to the print head 11. Next, in S12 the recording medium P is printed on by the print head 11.

Afterward, rather than immediately discharging the printed-on recording medium P by continuous rotation of the sheet feed roller 25 and the discharge roller 28, instead, in S13 the discharge operations are suspended while the lastly printed on portion of the recording medium P is held over the cooling platen 27 for a predetermined duration of time, which will be referred to as the first waiting time WT1, hereinafter. The first waiting time WT1 is prestored in the ROM 51 and is set to a value of, for example, 300 msec. After the lastly printed portion of the recording medium P has been held over the cooling platen 27 for the first waiting time WT1, then in S17, the sheet feed roller 25 and the discharge roller 28 are driven to rotate to discharge the recording medium P. This ends the control routine of FIG. 9.

On the other hand, if the temperature of the cooling platen 27 is not more than the second setting temperature TC2 (S8:YES) and also exceeds the first setting temperature TC1 (S10:NO), then in S14, one of the sheet supply units 2 or 3 supplies a recording medium P to the print head 11, whereupon in S15 the print head 11 prints on the recording medium P. After printing has been completed in S15, then in S16, the lastly printed portion of the recording medium P is held over the cooling platen 27 for a predetermined duration of time, which will be referred to as the second waiting time WT2, hereinafter. The second waiting time WT2 is also prestored in the ROM 51 and is set to a duration of time, for example, 500 msec., that is longer than the first waiting time WT1. After the lastly printed portion of the recording medium P has been held over the cooling platen 27 for the second waiting time WT2, the recording medium P is discharged in S17 and this control routine is ended.

In the first modified control routine, the control of discharge timing is added to the control of the sheet supply timing. Therefore, when the temperature of the cooling platen 27 is fairly low, so that the cooling platen 27 will be able to cool the recording medium P fairly rapidly, then the lastly printed portion of the recording medium P is held over the cooling platen 27 for only a relatively short time. On the other hand, when the temperature of the cooling platen 27 is fairly high, so that the cooling platen 27 requires a longer time to cool the recording medium P, then the lastly printed portion of the print medium P is held over the .-!Lo cooling platen 27 for a relatively long time. As a result, the lastly printed portion of the recording medium P can be held over the cooling platen 27 for an optimum duration of time corresponding to the temperature of the cooling platen 27. By the control process including the discharge timing control, the recording medium can be more efficiently cooled. Accordingly, efficiency of printing operations can be improved.

Figure 10:
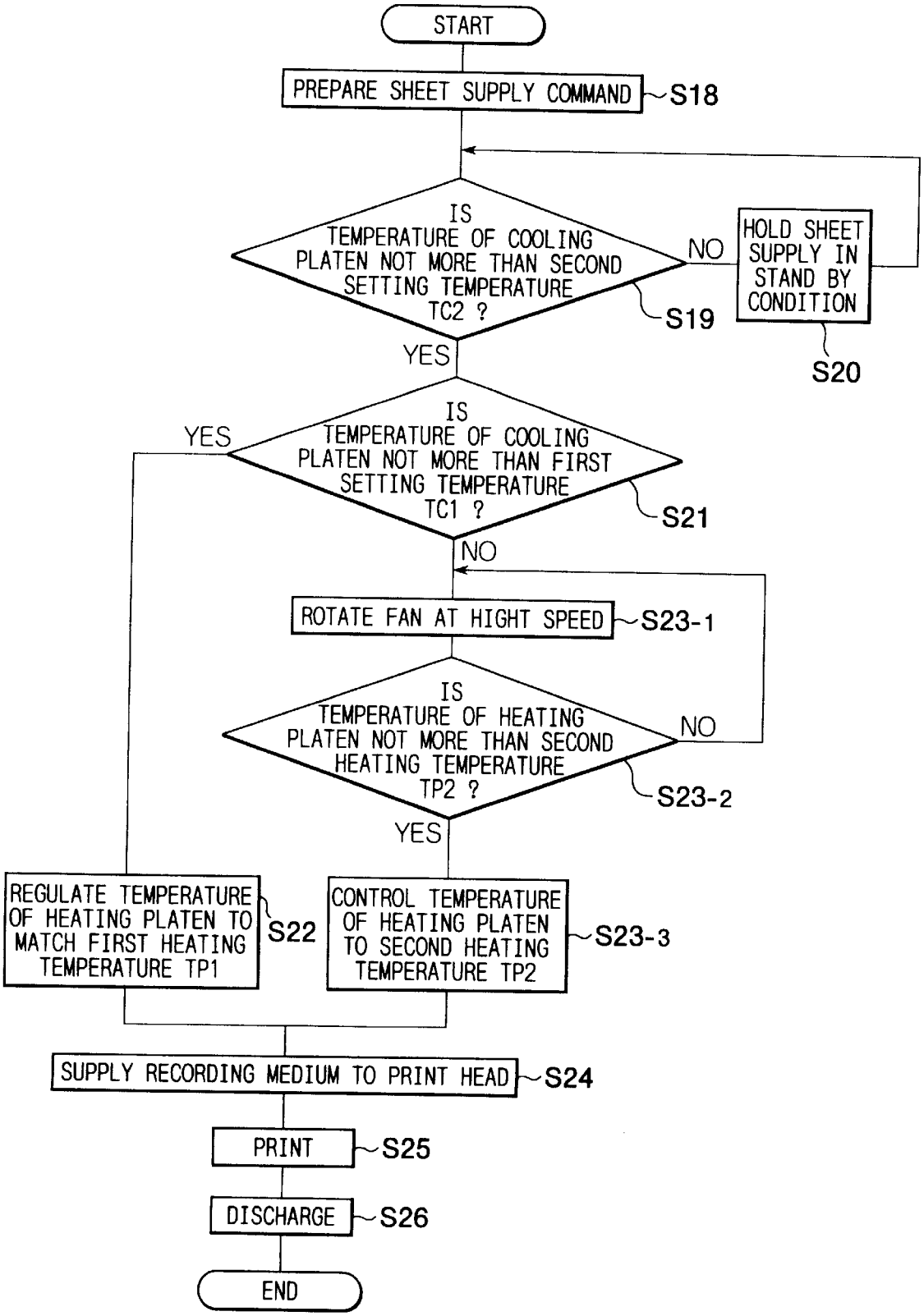
FIG. 10 is a flowchart representing a process for controlling sheet supply timing and a temperature of a heat platen according to another modified control routine.

A control routine according to a second modification is shown in a flowchart of FIG. 10. The second modification pertains to a control to the temperature of the heating platen (preheat platen 24 and the main platen 26) in accordance with the temperature of the cooling platen 27. In this control the temperatures of the preheat platen 24 and the main platen 26 are detected by pre-thermistor 69 and the main thermistor 70, respectively, and the temperature of the cooling platen 27 is detected by the temperature sensor 56.

This routine starts in the same manner as the routine explained while referring to the flowchart of FIG. 8. Further, steps S18, S19, and S20 are identical with the steps S1, S2 and S6 of FIG. 8 or with the steps S7, S8 and S9 of FIG. 9. If the temperature of the cooling platen 27 is equal to or less than the second setting temperature TC2 (S19:YES), then in S21, it is determined whether or not the temperature of the cooling platen 27 is equal to or less than the first setting temperature TC1, which is the same as the step S10 in FIG. 9. When the temperature of the cooling platen 27 is equal to or less than the first setting temperature TC2 (S21:YES), then in S22, the temperature of the heating platens 24, 26 are controlled to match a first heating temperature TP1. The first heating temperature TP1 is prestored in the ROM 51 and is set to, for example, 68° C. When the temperature of the cooling platen 27 is equal to or less than the second setting temperature TC2 (S19:YES) and also exceeds the first setting temperature TC1 (S21:NO), then a routine goes into step S23 having steps S23-1, S23-2 and S23-3 for controlling the temperature of the heating platens to a second heating temperature TP2 which is also prestored in the ROM 51 and is set to a temperature lower than the first heating temperature TP1, that is, for example TP2=60° C.

More specifically, in step S23-1, the CPU 50 transmits command signal to the fan driver circuit 65 so as to rotate the cooling fan 35 at a higher speed in order to cool the heating platens 24, 26. Then, in step S23-2, judgment is made as to whether or not the temperature of the heating platens 24, 26 becomes not more than a second heating temperature TP2. If the judgment falls No, the routine returns back to S23-1 to continue fan-cooling. On the other hand, if the temperature of the cooling platens becomes not more than the second heating temperature TP2, the routine proceeds into S23-3 where a control is made to maintain the temperature of the heating platens 24, 26 at the second heating temperature TP2.

After either of S22 and S23-3 are performed, then in S24, the recording medium P is supplied from one of the sheet supply units 2, 3 to the print head 11. The recording medium P is printed on by the print head 11 in S25, and then is discharged from the printer in S26. This ends the control routine represented by the flowchart in FIG. 10.

In the second modification, the control of the temperature of the heating platens 24, 26 is preformed in addition to the sheet supply timing control. For example, when the temperature of the cooling platen 27 is equal to or less than 45° C.(TC1), the temperature of the heating platens 24, 26 can be controlled to 68° C.(TP1). When the temperature of the cooling platen 27 exceeds 45° C.(TC1) and is also equal to or less than 50° C. (TC2), then the temperature of the heating platens 24, 26 can be controlled to 60° C. (TP2).

Said differently, when the temperature of the cooling platen is fairly low, then the temperature of the heating platens 24, 26 is increased so that ink can be more reliably fixed on the print medium P. On the other hand, when the temperature of the cooling platen 27 is fairly high, then the temperature of the heating platen 24, 26 can be lowered to a temperature which increases cooling efficiency of the cooling platen 27, but which does not adversely affect the fixation strength of ink. Accordingly, control operations can be refined and efficiency of print operations can be improved.

It should be noted that the control operations for controlling temperature of the heating platen 24, 26 are performed based on temperatures detected by the pre thermistor 69 and main thermistor 70 for the preheat platen 24 and the main platen 26. Based on the detected temperatures, a control command is transmitted from the CPU 50 to the heater control circuit 64 to heat the heating platens 24, 26 to the predetermined temperatures TP1, TP2. Further, the control command is also transmitted from the CPU 50 to the fan driver circuit 65 to cool the heating platen as in the step S23-1.

Figure 11:
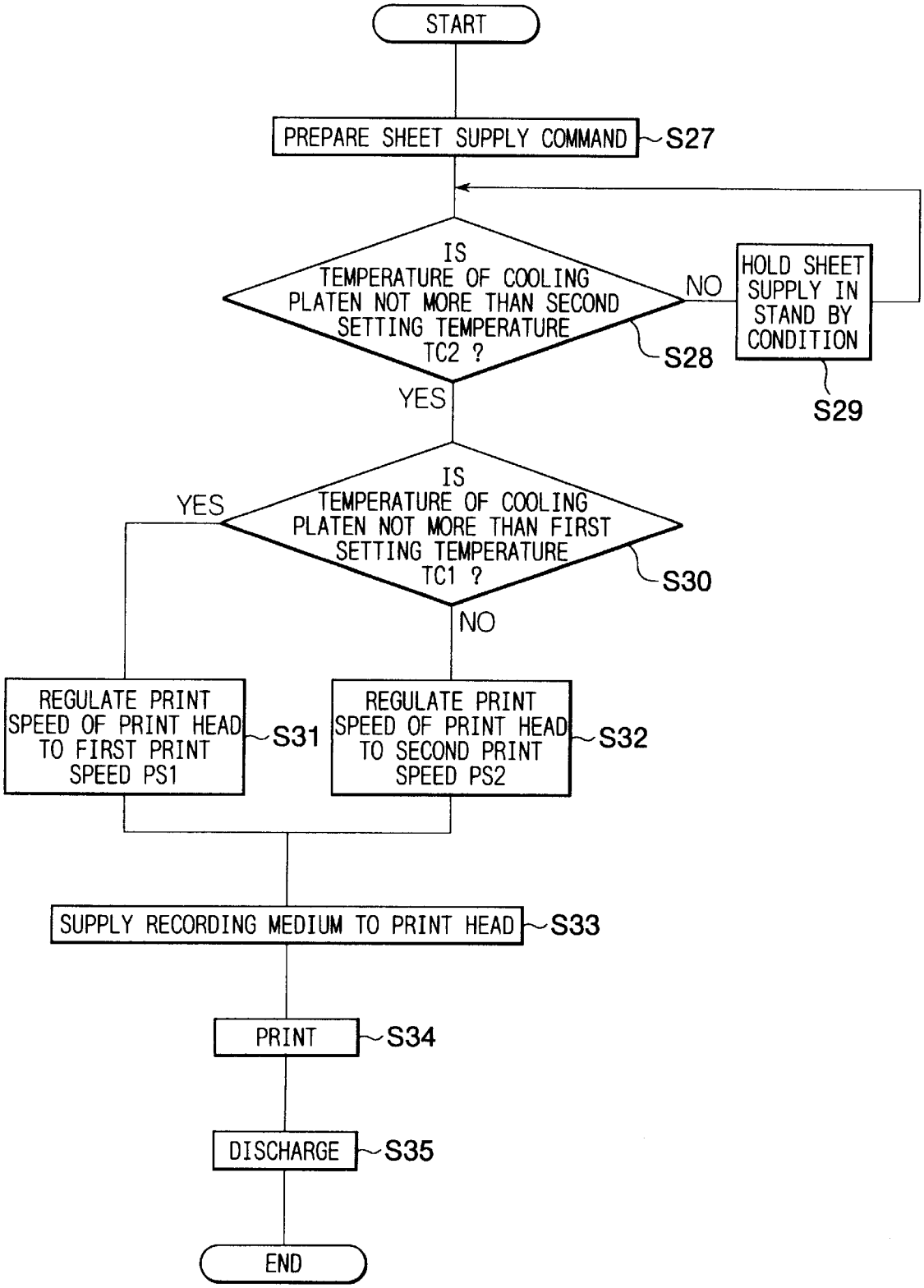
FIG. 11 is a flowchart representing a process for controlling sheet supply timing and a printing speed according to a still another modified control routine.

A control routine according to a third modification is shown in a flowchart of FIG. 11. The third modification pertains to a control to print speed of the nozzle head 13 according to the temperature detected for the cooling platen 27 by the temperature sensor 56 in addition to the control to the sheet supply timing toward the nozzle head 13.

In the routine of FIG. 11, the start timing and steps S27 through S30 are identical with the start timing and the steps S18 through S21 of FIG. 10. In the step S30, if the detected temperature of the cooling platen 27 is not more than the first setting temperature TC1 (S30:YES), then in S31, the print speed of the nozzle head 13 is controlled to a first print speed PS1. The first print speed PS1 is prestored in the ROM 51 and is set to, for example, 26.7 inches per second (ips).

On the other hand, if the temperature of the cooling platen 27 is determined to be not more than the second setting temperature TC2 (S28:YES) and to have exceeded the first setting temperature TC1 (S30:NO), then the routine proceeds into S32 where the print speed of the nozzle head 13 is controlled to a second print speed PS2. The second print speed PS2 is also provisionally stored in the ROM 51 and is set to a speed, for example, 13.4 ips, that is slower than the first print speed PS1.

Next, in S33 a recording medium P is supplied from one of the sheet supply units 2, 3. In S34, the print head 11 prints on the supplied recording medium P at print speed designated in S31 or S32. Afterward, the printed-on recording medium P is discharged in S35, thereby ending this control operation.

With this control routine, if the temperature of the cooling platen 27 is fairly low, so that the recording medium P can be quickly cooled, then printing can be performed at a fairly high speed so that printing operations can be quickly performed. On the other hand, if the temperature of the cooling platen 27 is fairly high, then the print speed of the nozzle head 13 is slowed down so that the recording medium P remains over the cooling platen 23 for a longer period of time to enhance cooling effects of the cooling platen 23. Because the recording medium P contacts the cooling platen 27 for a longer period of time, the recording medium P can be properly cooled. Therefore, cooling can be efficiently performed and efficiency of print operations can be improved.

It should be noted that during operations for controlling print speed of the nozzle head 13, the CPU 50 transmits signals to the carriage driver circuit 63 and the print head driver circuit 62 in order to drive the nozzle head 13 and the carriage motor 60 so that one band at a time is printed. Also, the CPU 50 transmits signals to the feed system driver circuit 66 in order to intermittently drive the sheet feed roller 25 and the discharge roller 28 by a predetermined feed amount. By doing this, portions of the recording medium P printed on one band amount at a time can be consecutively fed to the cooling platen 27.

While the invention has been described in detail and with reference to the specific embodiments thereof, it would be apparent to those skilled in the art that various changes and modifications may be made therein without departing from the spirit and scope of the invention.

For example, a gap is provided between the main platen 26 and the cooling platen 27 and the gap is plugged with an adiabatic member in order to prevent thermal transfer from the main platen 26 to the cooling platen 27. With this arrangement, the first suction port 36 is plugged by the adiabatic plug. However, it is also possible to provide cooling port(s) below the cooling platen 27 (equivalent to the second suction ports 37 shown in FIG. 4). With this construction, the cooling platen 27 can be reliably maintained at a low temperature by air passing through the second suction ports 37, whether during a printing operation or during a standby state, regardless of the position of the recording medium P being transferred. Alternatively, a first suction port can be formed in the adiabatic plug.

In the embodiment described above, the first suction port 36 is provided between the main platen 26 and cooling platen 27. However, the second suction ports 37 can be omitted. In place of the second suction ports 37, it is possible to provide other suction openings (not shown) in the frame 34 or the like. With this construction, it is possible to achieve temperature changes (temperature reductions) of the main platen 26 and the cooling function of the cooling platen 27 when the first suction port 36 is not blocked by the recording medium P, similar to the embodiment described above. Also, when the first suction port 36 is blocked by the recording medium P, it is possible to easily perform constant cooling of the power board 42 using air introduced into the frame 34 from the other suction openings.

Further, in the embodiment described above, the preheat platen 24 contacts the underside surface of the recording medium P, as does the main platen 26, in order to a5. preheat the recording medium P. However, it is not necessary for the preheat platen 24 to contact the underside surface of the recording medium P. For example, the preheat platen 24 can be provided to contact the top surface of the recording medium P (the surface on which ink is to be fixed), or two preheat platens could be provided in two places contacting both the top and underside surfaces of the recording medium P. A concave curved preheat platen provided to contact the top surface of the recording medium P could be particularly effective for heating the surface on which ink is to be fixed.

Further, the preheat platen 24 does not necessarily need to be as wide as or wider than the recording medium P. For example, if the material used for the recording medium P has some degree of thermal conductivity, a preheat platen slightly smaller than the recording medium P in the main scanning direction or provided in contact with the recording medium P in intervals in the widthwise direction would be sufficiently effective for preheating.

Further, various control routines are conceivable other than those described with reference to FIGS. 8 through 11. That is, in the illustrated embodiments, (a) control of the timing of the supply of the recording medium P to the print head 11 in accordance with the temperature of the cooling platen is performed (FIG. 8), and one of the (b) control of staying period of the printed recording medium on the cooling platen (FIG. 9), (c) control of the temperature of the heating platens 24, 26 (FIG. 10) and (d) control of the printing speed at the nozzle head 13 (FIG. 11) in accordance with the temperature of the cooling platen is added to the supply timing control(a). However, various combination among the controls (b) through (d) can be added to the control (a). Further, various combination among the controls (a) through (d) is available.

Further, the above described controls (a) through (d) are well-suited for the hot-melt type ink jet printers. However, these controls can be used appropriately with other types of printers as well.

What is claimed is:

1. A hot-melt type ink jet printer for forming an inked image on an image receiving medium comprising:

a frame;

a nozzle head ejecting a hot-melt ink onto the image receiving medium;

a main platen having one surface in confrontation with the nozzle head, the image receiving medium being fed in a feeding direction along the one surface, the main platen having an opposite surface;

a cooling platen positioned downstream of the main platen in the feeding direction for cooling the inked image formed on the image receiving medium, the cooling platen having one and opposite surfaces;

a discharge roller disposed downstream of the cooling platen for discharging the image receiving medium, the frame having a sheet discharge opening adjacent the discharge roller, an order of the main platen, the cooling platen and the discharge roller defining a sheet feed passage, wherein the frame is formed with a suction port at a position downstream of the main platen, the printer further comprises a fan disposed in the frame and positioned at a side facing the opposite surfaces of the main platen and the cooling platen, the fan introducing a cooling air into the frame through the sheet discharge opening and directing the cooling air toward the cooling platen through the suction port to cool the cooling platen, and the suction port includes a first suction port positioned between the main platen and the cooling platen at an upstream side of the cooling platen and open to the sheet feed passage so that the first suction port is closed by the image receiving medium when the image receiving medium passes along the sheet feed passage, and the hot-melt type ink jet printer further comprises an adiabatic partition member positioned in the first suction port for adiabatically separating the main platen from the cooling platen.

2. The hot-melt type ink Jet printer as claimed in claim 1, wherein the frame has a front side at which a printed image receiving medium is discharged, and a rear side at which the image receiving medium is supplied into the sheet feed passage, the fan being positioned at an intermediate portion between the front side and the rear side;

and the hot-melt type ink jet printer further comprising a power board positioned between the fan and the rear side of the frame, so that the cooling air sucked by the fan into the frame through the suction port is applied to the power board.

3. The hot-melt type ink jet printer as claimed in claim 1, wherein the image receiving medium has a first surface and a second surface opposite the first surface, the first surface being in confrontation with the nozzle head, and the second surface being in confrontation with the one surfaces of the main platen and the cooling platen;

and wherein the hot-melt type ink jet printer further comprising a main heater provided at the opposite surface of the main platen.

4. The hot-melt type ink jet printer as claimed in claim 1, wherein the suction port further includes a second suction port disposed downstream of the cooling platen and positioned offset from the sheet feed passage for supplying the cooling air toward the opposite surface of the cooling platen.

5. The hot-melt type ink jet printer as claimed in claim 2, further comprising a cooling fin provided at the opposite surface of the cooling platen and positioned in confrontation with the suction port.

6. The hot-melt type ink jet printer as claimed in claim 1, further comprising a control unit connected to the fan for controlling a rotation speed of the fan so that the fan rotates at a first speed during printing operation and at a second speed lower than the first speed during a standby state.

7. The hot-melt type ink Jet printer as claimed in claim 1, wherein the frame comprises a support frame supporting portions of the opposite surfaces of the main platen and the cooling platen, the support frame being formed with an air introduction port for allowing the cooling air sucked into the frame through the suction port to be directed toward the fan.

8. The hot-melt type ink jet printer as claimed in claim 2, wherein the frame comprises a support frame supporting portions of the opposite surfaces of the main platen and the cooling platen, the support frame being formed with an air introduction port for allowing the cooling air sucked into the frame through the suction port to be directed toward the fan.

9. The hot-melt type ink jet printer as claimed in claim 2, wherein the suction port includes a first suction port provided at a position between the main platen and the cooling platen, and a second suction port disposed at a downstream of the cooling platen.

10. The hot-melt type ink jet printer as claimed in claim 2, further comprising an adiabatic partition member positioned in the first suction port for adiabatically separating the main platen from the cooling platen, and wherein the rear side of the frame is formed with a discharge port through which the cooling air passing through the power board is discharged to an outside.

11. The hot-melt type ink jet printer as claimed in claim 2, further comprising a control unit connected to the fan for controlling a rotation speed of the fan so that the fan rotates at a first speed during printing operation and at a second speed lower than the first speed during a standby state.

12. A hot-melt type ink jet printer for forming an inked image on an image receiving medium comprising:

a frame;

a nozzle head ejecting a hot-melt ink onto the image receiving medium;

a main platen having one surface in confrontation with the nozzle head, the image receiving medium being fed in a feeding direction along the one surface, the main platen having an opposite surface;

a cooling platen positioned downstream of the main platen in the feeding direction for cooling the inked image formed on the image receiving medium, the cooling platen having one and opposite surfaces; and a discharge roller disposed downstream of the cooling platen for discharging the image receiving medium, the frame having a sheet discharge opening adjacent the discharge roller, an order of the main platen, the cooling platen and the discharge roller defining a sheet feed passage, wherein a combination of the nozzle head and the main platen constitutes a printing portion, and the hot-melt type ink jet printer further comprising:

a temperature sensor provided downstream of the printing portion detecting a temperature of the cooling platen; and means for controlling a printing speed of the nozzle head in accordance with a temperature detected by the temperature sensor.

13. A hot-melt type ink jet printer for forming an inked image on an image receiving medium comprising:

a frame;

a nozzle head ejecting a hot-melt ink onto the image receiving medium;

a main platen having one surface in confrontation with the nozzle head, the image receiving medium being fed in a feeding direction along the one surface, the main platen having an opposite surface;

a cooling platen positioned downstream of the main platen in the feeding direction for cooling the inked image formed on the image receiving medium, the cooling platen having one and opposite surfaces; and a discharge roller disposed downstream of the cooling platen for discharging the image receiving medium, the frame having a sheet discharge opening adjacent the discharge roller, an order of the main platen, the cooling platen and the discharge roller defining a sheet feed passage, wherein a combination of the nozzle head and the main platen constitutes a printing portion, and the hot-melt type ink jet printer further comprising:

a preheat platen provided between the sheet supplying section and the main platen;

a temperature sensor provided downstream of the printing portion detecting a temperature of the cooling platen; and means for controlling a temperature of the preheat platen in accordance with a temperature detected by the temperature sensor.

14. A hot-melt type ink jet printer for forming an inked image on an image receiving medium comprising:

a frame;

a nozzle head ejecting a hot-melt ink onto the image receiving medium;

a main platen having one surface in confrontation with the nozzle head, the image receiving medium being fed in a feeding directing along the one surface, the main platen having an opposite surface;

a cooling platen positioned downstream of the main platen in the feeding direction for cooling the inked image formed on the image receiving medium, the cooling platen having one and opposite surfaces;

a discharge roller disposed downstream of the cooling platen for discharging the image receiving medium, the frame having a discharge port adjacent the discharge roller, an order of the main platen, the cooling platen and the discharge roller defining a sheet feed passage;

a sheet supplying section storing a stack of the image receiving mediums and having a sheet supply opening for supplying each one of the image receiving mediums of the stack;

a sheet feed roller disposed downstream of the sheet supplying section and upstream of the cooling platen, a combination of the sheet supply opening, the main platen, the sheet feed roller, the cooling platen and the discharge roller defining an arcuate sheet feed passage protruding toward the nozzle head; and an urging segment connected between the cooling platen and the frame for urging the cooling platen toward the nozzle head so that the one surface of the cooling platen is discontinuous from the arcuate sheet feed passage.

15. The hot-melt type ink jet printer as claimed in claim 14, further comprising:

a preheat platen positioned between the sheet supply opening and the sheet feed roller, the preheat platen having one surface and opposite surface;

a preheater provided at the opposite surface of the preheat platen;

a main heater provided at the opposite surface of the main platen, and wherein the main platen is positioned downstream of the sheet feed roller, each one surface of the preheater, main heater and the cooling platen being arcuately curved.

16. The hot-melt type ink jet printer as claimed in claim 14, wherein the urging segment provides a biasing force that yields the one surface of the cooling platen to be in conformance with the arcuate sheet feed passage by a tension of the image receiving medium the tension being imparted by the sheet feed roller and the discharge roller.

17. The hot-melt type ink jet printer as claimed in claim 15, further comprising at least one baffle having a free end urged toward at least one of one surfaces of the preheat platen and the main platen for pressing the image receiving medium on the one surface.

18. A hot-melt type ink jet printer for forming an inked image on an image receiving medium comprising:

a frame;

a nozzle head ejecting a hot-melt ink onto the image receiving medium;

a main platen having one surface in confrontation with the nozzle head, the image receiving medium being fed in a feeding direction along the one surface, the main platen having an opposite surface;

a cooling platen positioned downstream of the main platen in the feeding direction for cooling the inked image formed on the image receiving medium, the cooling platen having one and opposite surfaces; and a discharge roller disposed downstream of the cooling platen for discharging the image receiving medium, the frame having a sheet discharge opening adjacent the discharge roller, an order of the main platen, the cooling platen and the discharge roller defining a sheet feed passage, wherein a combination of the nozzle head and the main platen constitutes a printing portion, and the hot-melt type ink jet printer further comprising:

a sheet supplying section for supplying each one of the image receiving mediums to the printing portion;

a temperature sensor provided downstream of the printing portion detecting a temperature of the cooling platen; and means for controlling a supplying timing of the image receiving medium from the sheet supplying section in accordance with a temperature detected by the temperature sensor.

19. The hot-melt type ink jet printer as claimed in claim 18, further comprising means for temporarily stopping a printed image receiving medium upon the cooling platen for a selected period in accordance with a temperature detected by the temperature sensor.

20. The hot-melt type ink jet printer as claimed in claim 18, further comprising means for controlling a temperature of the main platen in accordance with a temperature detected by the temperature sensor.

21. The hot-melt type ink jet printer as claimed in claim 18, further comprising a preheat platen provided between the sheet supplying section and the main platen; and means for controlling a temperature of the preheat platen in accordance with a temperature detected by the temperature sensor.

22. The hot-melt type ink jet printer as claimed in claim 18, further comprising means for controlling a printing speed of the nozzle head in accordance with a temperature detected by the temperature sensor.

23. A hot-melt type ink jet printer for forming an inked image on an image receiving medium comprising:

a frame;

a nozzle head ejecting a hot-melt ink onto the image receiving medium;

a main platen having one surface in confrontation with the nozzle head, the image receiving medium being fed in a feeding direction along the one surface, the main platen having an opposite surface;

a cooling platen positioned downstream of the main platen in the feeding direction for cooling the inked image formed on the image receiving medium, the cooling platen having one and opposite surfaces; and a discharge roller disposed downstream of the cooling platen for discharging the image receiving medium, the frame having a sheet discharge opening adjacent the discharge roller, an order of the main platen the cooling platen and the discharge roller defining a sheet feed passage, wherein a combination of the nozzle head and the main platen constitutes a printing portion, and the hot-melt type ink jet printer further comprising:

a temperature sensor provided downstream of the printing portion detecting a temperature of the cooling platen; and means for temporarily stopping a printed image receiving medium upon the cooling platen for a selected period in accordance with a temperature detected by the temperature sensor.

24. A hot-melt type ink jet printer for forming an inked image on an image receiving medium comprising:

a frame;

a nozzle head ejecting a hot-melt ink onto the image receiving medium;

a main platen having one surface in confrontation with the nozzle head, the image receiving medium being fed in a feeding direction along the one surface, the main platen having an opposite surface;

a cooling platen positioned downstream of the main platen in the feeding direction for cooling the inked image formed on the image receiving medium, the cooling platen having one and opposite surfaces; and a discharge roller disposed downstream of the cooling platen for discharging the image receiving medium, the frame having a sheet discharge opening adjacent the discharge roller, an order of the main platen, the cooling platen and the discharge roller defining a sheet feed passage, wherein a combination of the nozzle head and the main platen constitutes a printing portion, and the hot-melt type ink jet printer further comprising:

a temperature sensor provided downstream of the printing portion detecting a temperature of the cooling platen; and means for controlling a temperature of the main platen in accordance with a temperature detected by the temperature sensor.

* * * * *